United States Patent [19]

Clark et al.

[11] 4,327,169

[45] Apr. 27, 1982

[54] INFRARED SENSITIVE PHOTOCONDUCTIVE COMPOSITION, ELEMENTS AND IMAGING METHOD USING TRIMETHINE THIOPYRYLIUM DYE

[75] Inventors: Suzanne P. Clark; George A. Reynolds; Jerome H. Perlstein, all of Rochester, N.Y.

[73] Assignee: Eastman Kodak Company, Rochester, N.Y.

[21] Appl. No.: 226,340

[22] Filed: Jan. 19, 1981

[51] Int. Cl.[3] ..... G03G 5/06

[52] U.S. Cl. ..... 430/75; 430/944

[58] Field of Search ..... 430/75, 944

[56] References Cited

U.S. PATENT DOCUMENTS

| | | | |
|---|---|---|---|
| 3,615,414 | 10/1971 | Light | 430/74 |
| 3,732,180 | 5/1973 | Gramza et al. | 260/33.6 R |
| 3,881,924 | 5/1975 | Murakami et al. | 430/81 |

*Primary Examiner*—John D. Welsh

*Attorney, Agent, or Firm*—John R. Everett

[57] ABSTRACT

Infrared sensitive heterogeneous photoconductive composition, elements and imaging method is presented. The composition comprises a continuous phase of a film-forming electrically insulating polymer having dispersed therein a plurality of crystalline particles consisting of an electrically insulating polymer and a trimethine thiopyrylium dye conforming to the general formula:

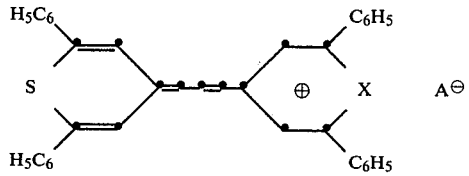

I.

wherein:

X is sulfur or selenium and A⊖ is an anion.

14 Claims, No Drawings

INFRARED SENSITIVE PHOTOCONDUCTIVE COMPOSITION, ELEMENTS AND IMAGING METHOD USING TRIMETHINE THIOPYRYLIUM DYE

FIELD OF THE INVENTION

This invention relates to electrophotoconductive composition, elements and imaging method and particularly to infrared sensitive photoconductive composition, elements and imaging method.

BACKGROUND OF THE INVENTION

Electrophotographic imaging processes and techniques have been extensively described in the prior art. Generally, such processes have in common the step of imagewise exposing a photoconductive element to electromagnetic radiation to which the element is sensitive, thereby forming a latent electrostatic charge image. A variety of subsequent operations, well known in the art, are then employed to produce a permanent record of the image.

One type of photoconductive element particularly useful in electrophotography employs a composition containing a photoconductive material and an electrically insulating resinous binding material. An integrated electrophotographic element incorporating such a composition is generally produced in a multilayer type of structure by coating a layer of the above-described composition onto a support previously overcoated with a layer of an electrically conducting material. Alternatively, the above-described composition can be coated directly onto a conductive support made of metal or other suitable conductive materials.

The desired electrophotographic properties are dictated by the end use contemplated for the photoconductive element. In many such applications, it is desirable for the photoconductive element to exhibit high speed, as measured by an electrical speed or characteristic curve, a low residual potential after exposure and resistance to electrical fatigue. Various other applications specifically require that the photoconductive element be capable of high speeds with infrared radiation (about 870 to about 970 nm).

High speed "heterogeneous" or "aggregate" photoconductive systems have been developed which exhibit many of the desirable qualities mentioned above. These aggregate compositions are the subject matter of William A. Light, U.S. Pat. No. 3,615,414 issued Oct. 26, 1971, and Gramza et al., U.S. Pat. No. 3,732,180 issued May 8, 1973. These heterogeneous or aggregate photoconductive elements comprise photoconductive compositions containing a continuous polymer phase having dispersed therein co-crystalline particles composed on a pyrylium or thiopyrylium salt and a polymer. Although these elements are useful in many applications, they do not respond to infrared activating radiation.

SUMMARY OF THE INVENTION

The present invention provides photoconductive compositions and elements which comprise an infrared sensitive heterogeneous photoconductive composition, said composition comprising a continuous phase of a film-forming electrically insulating polymer having dispersed therein a plurality of crystalline particles consisting of an electrically insulating polymer and a trimethine thiopyrylium dye conforming to the general formula:

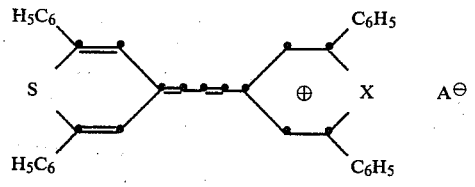

I.

wherein:

X is sulfur or selenium and $A^{\ominus}$ is an anion such as perchlorate or fluoroborate.

In a preferred embodiment of the present invention there are provided photoconductive compositions and elements comprising an infrared sensitive heterogeneous photoconductive composition, said composition comprising a continuous phase of a film-forming electrically insulating polymer having dissolved therein an organic photoconductor and dispersed therein a plurality of crystalline particles consisting of an electrically insulating polymer and a trimethine thiopyrylium dye conforming to general Formula I.

DETAILED DESCRIPTION OF THE INVENTION

Useful materials within the scope of Formula I include 4-[(2,6-diphenyl-4H-thiopyran-4-ylidene)-2-propene]-2,6-diphenylthiopyrylium perchlorate and 4-[(2,6-diphenyl-4H-thiopyran-4-ylidene)-2-propene]-2,6-diphenylselenopyrylium perchlorate.

The photoconductive compositions of the present invention are obtained by treating compositions comprising a dye material as described above and an electrically insulating polymer with a solvent vapor. The treatment can be carried out in several ways. For example, a solution containing the selected dye material, the electrically insulating polymer and, if desired, a material which is an organic photoconductor is coated in the form of a layer in a conventional manner onto a suitable support. Treatment is then carried out in situ by contact of the coating with the vapors of a solvent until a color change is noted in the coating. Also treatment can be carried out by inhibition of solvent removal in an otherwise conventional coating operation of a solvent dope containing the dye and polymer and when desired, an organic photoconductor. Similarly, coating such a layer from a solvent mixture containing a higher boiling solvent which persists in the coating during drying is among the useful methods.

In general, the infrared sensitive photoconductive compositions of the examples have been prepared by mixing together separate solutions of the selected dye material and the electrically insulating polymer and then, if desired, adding an organic photoconductor. The solution is then coated on a conductive support, such as a nickel-coated poly(ethylene terephthalate) film support, and dried in air or under vacuum at about 60° C.

Treatment according to one of the above procedures results in a transformation in the composition. The transformation is evidenced by increased speed, a change in the absorption spectrum and the appearance of microscopic crystalline particles of the solvent treated coated composition.

The organic coating solvents useful for preparing coating dopes are selected from a variety of materials. Useful liquids include substituted hydrocarbon solvents, with preferred materials being halogenated hydrocarbon solvents. The requisite properties of the solvent are that it be capable of dissolving the selected dye material and be capable of dissolving or at least highly swelling or solubilizing the polymeric ingredient of the composition. In addition, it is helpful if the solvent is easily removed from the coating, for example, a volatile solvent having a boiling point of less than about 200° C. Particularly useful solvents include halogenated lower alkanes having from 1 to 3 carbon atoms.

Solvents used in transforming the coated layers into the infrared sensitive photoconductive compositions and layers of the present invention include, dichloromethane, toluene, tetrahydrofuran, p-dioxane, chloroform and 1,1,1-trichloroethane. Such solvents are useful alone or in combination, in which case each component of the combination need not be a solvent for the particular dye material used. The particular solvent(s) used will, in some cases, be determined by the particular combination of electrically insulating polymer, dye material and the material used as the organic photoconductor. For example, in some cases one solvent causes a particular polymer, organic photoconductor or dye material to precipitate out of the coated composition while other solvents will result in the desired photoconductive compositions.

The amount of the selected dye material incorporated into photoconductive compositions and elements of the present invention is varied over a relatively wide range. When such compositions do not include an organic photoconductive material, the selected dye material is preferably present in an amount of about 0.001 to about 50.0 percent by weight of the coating composition on a dry basis. Larger or smaller amounts of the selected dye material may also be employed, although best results are generally obtained when using an amount within the aforementioned range. When the compositions include an organic photoconductive material, useful results are obtained by using the selected dye material in amounts of about 0.001 to about 30 percent by weight of the photoconductive coating composition. The upper limit in the amount of dye material present in a sensitized layer is determined as a matter of choice and the total amount of any dye material used varies widely depending on the material selected, the electrophotographic response desired, the proposed structure of the photoconductive element and the mechanical properties desired in the element.

Useful polymers include polystyrene, poly(methylmethacrylate), poly(4,4'-isopropylidenediphenylene carbonate) and a condensation polymer of terephthalic acid, ethylene glycol and 2,2'-bis[4-(2-hydroxyethoxy)]-propane.

Useful organic photoconductive materials are generally electron acceptors or electron donors for the particles of electrically insulating polymer and the dye of Formula I. Such materials may be selected from materials designated as organic photoconductors in the patent literature such as those disclosed in U.S. Pat. Nos. 3,615,414; 3,873,311; 3,873,312 and *Research Disclosure* 10938, Volume 109, May, 1973. These disclosures are expressly incorporated herein by reference. Useful materials include aromatic amines such as tri-p-tolylamine and (di-p-tolylaminophenyl)cyclohexane. Polymeric organic photoconductors are also useful.

In general, organic photoconductive materials, when used, are present in the composition in an amount equal to at least about 1 weight percent of the coating composition on a dry basis. The upper limit in the amount of photoconductor substance present can be widely varied in accordance with usual practice. It is preferred that the organic photoconductor material be present, on a dry basis, in an amount of from about 1 weight percent of the coating composition to the limit of its solubility in the polymeric binder. A particularly preferred weight range for the organic photoconductor in the coating composition is from about 10 weight percent to about 40 weight percent on a dry basis.

Suitable support materials for the photoconductive compositions of this invention include any of a wide variety of electrically conducting supports, such as, paper (at a relative humidity about 20 percent); aluminum-paper laminates; metal foils such as aluminum foil, zinc foil, etc; metal plates such as aluminum, copper, zinc, brass and galvanized plates; vapor-deposited metal layers such as silver, chromium, nickel, aluminum, cermet materials and the like coated on paper or conventional photographic film bases such as cellulose acetate or polystyrene. Such conducting materials as nickel can be vacuum deposited on transparent film supports in sufficiently thin layers to allow electrophotographic elements prepared therewith to be exposed from either side of such elements. An especially useful conducting support is prepared by coating a support material such as poly(ethylene terephthalate) with a conducting layer containing a semiconductor dispersed in a resin. Such conducting layers both with and without insulating barrier layers are described in U.S. Pat. Nos. 3,245,833 and 3,880,657. Likewise, a suitable conducting coating can be prepared from the sodium salt of a carboxyester lactone of maleic anhydride and a vinyl acetate polymer. Such conducting layers and methods for their optimum preparation and use are disclosed in U.S. Pat. Nos. 3,007,901 and 3,262,807.

The photoconductive compositions of this invention can be coated directly on a conducting substrate. In some cases, it is desirable to use one or more intermediate subbing layers between the conducting substrate and coating to improve adhesion of the coating to the conducting substrate and/or to act as an electrical barrier layer between the coated composition and the conducting substrate. Such subbing layers, if used, generally have a dry thickness in the range of about 0.1 to about 5 microns. Subbing layer materials which are used are described, for example, in U.S. Pat. Nos. 3,143,421; 3,640,708 and 3,501,301.

Overcoat layers are useful in the present invention, if desired. For example, to improve surface hardness and resistance to abrasion, the coated layer of the element of the invention is overcoated with one or more electrically insulating, organic polymer coatings or electrically insulating, inorganic coatings. A number of such coatings are well known in the art and accordingly extended discussion thereof is unnecessary. Useful such overcoats are disclosed, for example, in *Research Disclosure,* "Electrophotographic Elements, Materials, and Processes," Volume 109, page 63, Paragraph V, May, 1973, which is incorporated herein by reference.

Coating thicknesses of the photoconductive composition on the support can vary widely. Generally, a coating in the range of about 0.5 micron to about 300 microns before drying is useful for the practice of this invention. The preferred range of coating thickness is found to be in the range from about 1.0 micron to about 150 microns before drying, although useful results can be obtained outside of this range. The resultant dry thickness of the coating is preferably between about 2 microns and about 50 microns, although useful results can be obtained with a dry coating thickness between about 1 and about 200 microns.

The elements of the present invention can be employed in any of the well-known electrophotographic processes which require photoconductive layers. One such process is the xerographic process. In a process of this type, an electrophotographic element is held in the dark and given a blanket electrostatic positive or negative charge by treating it with a corona discharge. This uniform charge is retained by the layer because of the substantial dark insulating property of the layer, i.e., the low electrical conductivity of the layer in the dark. The electrostatic charge formed on the surface of the photoconductive layer is then selectively dissipated from the surface of the layer by imagewise exposure to infrared radiation by means of a conventional front surface, or if the electrode is transparent rear surface, exposure operation such as, for example, by a contact-printing technique, or by projection of an image, and the like, to thereby form a latent electrostatic image in the photoconductive layer.

The latent electrostatic image produced by exposure is then developed or transferred to another surface and developed there, i.e., either the charged or uncharged areas are rendered visible, by treatment with a medium comprising electrostatically responsive particles having optical density (electroscopic toners). The developing electrostatically responsive particles can be in the form of dust, i.e., powder, or a pigment in a resinous carrier, i.e., toner.

Liquid development of the latent electrostatic image formed on the elements of this invention is preferred. In liquid development, the developing particles (electroscopic toners) are carried to the image-bearing surface in an electrically insulating liquid carrier. Methods of development of this type are widely known and have been described in the patent literature, for example, Metcalfe et al, U.S. Pat. No. 2,907,674 issued Oct. 6, 1959. Liquid toners which are especially useful include those disclosed in U.K. patent specification No. 935,621; U.S. Pat. Nos. 3,362,907; 3,900,413; 3,992,311; 4,049,446; 3,836,361 and 3,918,966 and U.K. Pat. No. 1,370,526.

The following examples are presented:

EXAMPLES 1–6

Electrophotographic coatings of these examples generally contain about 2 percent by weight of the dye 4-[(2,6-diphenyl-4H-thiopyran-4-ylidene)-2-propene]-2,6-diphenylthiopyrylium perchlorate; 37 percent, by weight, tri-p-tolylamine; and 61 percent, by weight, polymer. Aggregation was obtained with a variety of polymers including polystyrene, poly(methyl methacrylate), poly-(4,4'-isopropylidenediphenylene carbonate) available from General Electric as Lexan® 145, and a condensation polymer of terephthalic acid, ethylene glycol and 2,2'-bis[4-(2-hydroxyethoxy)]propane (Vitel® PE-101). Conductive supports for coatings of the invention include nickel, gold, aluminum or chromium cermet coated on a poly(ethylene terephthalate) support.

The following film preparation serves as an example of the techniques used to prepare the films of these examples: Table I provides the essential data needed to prepare the films.

TABLE I

Data for Film Preparation

| Example No. | Polymer | Quantity of Dye (mg) | Quantity of Tri-p-tolylamine (mg) | Film Thickness $\mu$ | Optical Density at $\lambda$ = 900 nm | Oven Drying Time (hours) |
|---|---|---|---|---|---|---|
| 1 | Lexan® 145 | 21.3 | 298.6 | 8.0 | .68 | 24 (60° C.) |
| 2 | Lexan® 145 | 14.3 | 298.6 | 9.6 | .59 | 24 (60° C.) |
| 3 | Polystyrene | 16.1 | 296.2 | 6.8 | .68 | 24 (60° C.) |
| 4 | Polystyrene | 16.5 | 306.2 | 8.8 | .57 | 17 (55° C.) |
| 5 | Polystyrene | 15.3 | 304.6 | 5.0 | .60 | 24 (55° C.) |
| 6 | Vitel® PE-101 | 15.6 | 297.8 | Uneven Surface | .10 | 2 (55° C.) |

A solution was prepared containing 16.1 mg 4[(2,6-diphenyl-4H-thiapyran-4-ylidene)-2-propene]-2,6-diphenyl thiopyrylium perchlorate and 296.2 mg tri-p-tolylamine in 2.0 ml dichloromethane and 0.4 ml 1,1,1,3,3,3-hexafluoroisopropanol (HFIP). The latter solution was combined with 5 ml of a polymer solution containing 0.1 g polystyrene/1 ml dichloromethane. This mixture was swirled, heated one minute, and then coated at room temperature on a conducting support. Upon solvent evaporation, the film went from a light olive green to a darker blue-green color. The resulting film was air-dried on a block 2 to 3 minutes at 50° C.

All six films were fumed with p-dioxane to form the photoconductive aggregate state. Fuming times were on the order of 1–3 minutes depending on the temperature of the dioxane bath. The films as coated contain noncrystalline "sea sandlike" particles when viewed at 2500× magnification. The optical spectrum of the film before vapor treatment had an absorption maximum at 700 nm and 780 nm. There was also a short wavelength peak at $\lambda$=415 nm. After vapor treatment blue-green 4-[(2,6-diphenyl-4H-thiopyran-4-ylidene)-2-propene]-2,6-diphenylthiopyrylium perchlorate aggregates formed. The aggregate film spectrum is characterized by a fairly flat, broad absorption band between 660 nm and 880 nm and a short wavelength peak at 420 nm. The films were charged to a field strength, $E_o$, of about $10^5$ V/cm. At this field strength there is virtually no photoconduction of the unfumed film.

In Table II the photodischarge sensitivities are listed for negative charging, front surface exposure, low light intensity discharge from $E_o$ of about $10^5$ V/cm to 1/5 $E_o$ at 900 nm.

TABLE II

Photodischarge Sensitivities at 900 nm
For Negative Charging Front Surface Exposure

| Example No. | $E_o$ V/cm | Photodischarge Sensitivity (ergs/cm$^2$ from $E_o$ to $E_o$/5) |
|---|---|---|
| 1 | $-7.5 \times 10^4$ | 60 |
| 2 | $-1.2 \times 10^5$ | 91 |
| 3 | $-1.6 \times 10^5$ | 69 |
| 4 | $+3.4 \times 10^5$ | 16.4[1] |

TABLE II-continued

| Photodischarge Sensitivities at 900 nm For Negative Charging Front Surface Exposure | | |
|---|---|---|
| Example No. | $E_o$ V/cm | Photodischarge Sensitivity (ergs/cm$^2$ from $E_o$ to $E_o/5$) |
| 5 | $-1.8 \times 10^5$ | 46 |
| 6 | — | 62 |

[1]This sensitivity was calculated for discharge of $E_o$ to $\frac{1}{2}$ $E_o$, positive charging front surface exposure.

EXAMPLE 7

18.5 mg of 4-[(2,6-diphenyl-4H-thiopyran-4-ylidene)-2-propene]-2,6-diphenylselenapyrylium perchlorate and 307.1 mg of tri-p-tolylamine were dissolved in 5 ml of dichloromethane containing 500 mg of polystyrene. The solution was coated on a conductive support as in Examples 1–6 and then vapor treated with p-dioxane. The optical spectrum of the film before vapor treatment had an absorption maximum at 820 nm and 720 nm. The optical spectrum of the film after vapor treatment had an absorption band between 720 nm and 950 nm. Half decay photodischarge sensitivity for $E_o = 8.3 \times 10^4$ V/cm at 900 nm was 51 erg/cm$^2$.

This invention has been described in detail with particular reference to preferred embodiments thereof, but it will be understood that variations and modifications can be effected within the spirit and scope of the invention.

We claim:

1. An infrared sensitive heterogeneous photoconductive composition, said composition comprising a continuous phase of a film-forming electrically insulating polymer having dispersed therein a plurality of crystalline particles consisting of an electrically insulating polymer and a trimethine thiopyrylium dye conforming to the general formula:

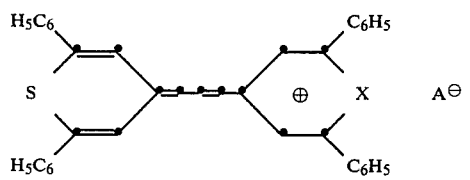

wherein:

X is sulfur or selenium and A⊖ is an anion.

2. An infrared sensitive heterogeneous photoconductive composition, said composition comprising a continuous phase of a film-forming electrically insulating polymer having dissolved therein an organic photoconductor and dispersed therein a plurality of crystalline particles consisting of an electrically insulating polymer and a trimethine thiopyrylium dye conforming to the general formula:

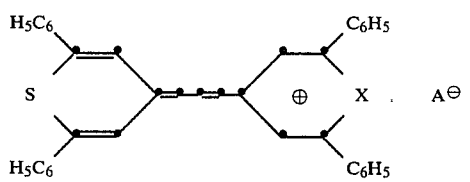

wherein:

X is sulfur or selenium and A⊖ is an anion.

3. A photoconductive composition as in claim 1 or 2, wherein said dye material is present in said composition in an amount of about 0.001 to about 30 weight percent on a dry basis.

4. A photoconductive composition according to claim 2, wherein said organic photoconductor is tri-p-tolylamine.

5. A photoconductive composition as in claims 1 or 2, wherein the continuous phase electrically insulating polymer and the polymer included in the particles are the same.

6. A photoconductive composition as in claims 1 or 2, wherein the electrically insulating polymers are selected from the group consisting of polystyrene; Biphenol A polycarbonate; a condensation polymer of terephthalic acid, ethylene glycol and 2,2'-bis-[4-(2-hydroxyethoxy)]propane; and poly(methyl methacrylate).

7. An infrared sensitive heterogeneous photoconductive composition comprising a continuous phase of polystyrene having dissolved therein tri-p-tolylamine and having dispersed therein particles consisting of polystyrene and 4-[(2,6-diphenyl-4H-thiopyran-4-ylidene)-2-propene]-2,6-diphenylselenapyrylium perchlorate.

8. An electrophotographic element comprising an electrically conducting support and a layer of an infrared sensitive heterogeneous photoconductive composition, said composition comprising a continuous phase of a film-forming electrically insulating polymer having dispersed therein a plurality of crystalline particles consisting of an electrically insulating polymer and a trimethine thiopyrylium dye conforming to the general formula:

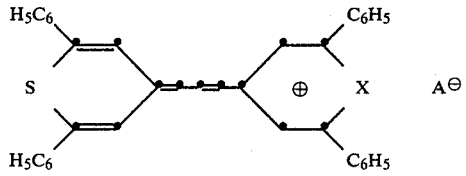

wherein:

X is sulfur or selenium and A⊖ is an anion.

9. An electrophotographic element comprising an electrically conducting support and a layer of an infrared sensitive heterogeneous photoconductive composition, said composition comprising a continuous phase of a film-forming electrically insulating polymer having dissolved therein an organic photoconductor and dispersed therein a plurality of crystalline particles consisting of an electrically insulating polymer and a trimethine thiopyrylium dye conforming to the general formula:

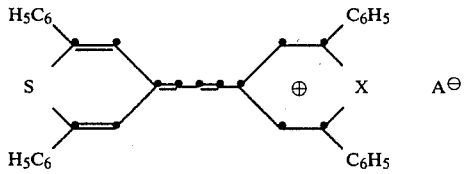

wherein:

is sulfur or selenium and A⊖ is an anion.

10. A element as in claim 9 wherein said polymers are selected from the group consisting of polystyrene, poly(4,4'-isopropylidenediphenylene carbonate), poly(methyl methacrylate) and a condensation polymer of terephthalic acid, ethylene glycol and 2,2'-bis[4-(2-hydroxyethoxy)]propane.

11. A method for forming images with infrared radiation comprising the steps of:

(a) electrostatically charging an electrophotographic element;

(b) exposing said element to an image pattern of infrared radiation;

(c) contacting said element with an electroscopic toner to develop said image pattern, characterized in that said element comprises a layer of an infrared sensitive heterogeneous photoconductive composition, said composition comprising a continuous phase of a film-forming electrically insulating polymer having dispersed therein a plurality of crystalline particles consisting of an electrically insulating polymer and a trimethine thiopyrylium dye conforming to the general formula:

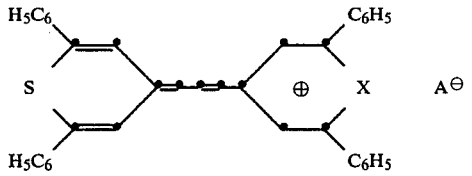

wherein:

X is sulfur or selenium and $A^{\ominus}$ is an anion.

12. A method as in claim 11 wherein said infrared sensitive layer includes an organic photoconductor dissolved in the electrically insulating polymer.

13. A method as in claim 11 wherein the electrically insulating polymers are selected from the group consisting of polystyrene, poly(4,4'-isopropylidenediphenylene carbonate, poly(methyl methacrylate) and a condensation polymer of terephthalic acid, ethylene glycol and 2,2'-bis[4-(2-hydroxyethoxy)]propane.

14. A method as in claim 11 wherein said element is contacted with a liquid developer containing electroscopic toners in step (c).

* * * * *